US005133801A

United States Patent [19]

Saarinen

[11] Patent Number: 5,133,801

[45] Date of Patent: Jul. 28, 1992

[54] METHOD AND APPARATUS FOR FEEDING REACTING SUBSTANCES INTO A SMELTING FURNACE

[75] Inventor: Risto U. Saarinen, Espoo, Finland

[73] Assignee: Outokumpu Oy, Helsinki, Finland

[21] Appl. No.: 645,138

[22] Filed: Jan. 24, 1991

[30] Foreign Application Priority Data

Jan. 25, 1990 [FI] Finland ..... 900409

[51] Int. Cl.[5] ..... F27B 1/20

[52] U.S. Cl. ..... 75/707

[58] Field of Search ..... 75/707; 266/182

[56] References Cited

U.S. PATENT DOCUMENTS 2,850,372 9/1958 Planiol ..... 75/707

4,210,315 1/1980 Lilja ..... 75/707

*Primary Examiner*—Peter D. Rosenberg

*Attorney, Agent, or Firm*—Brooks Haidt Haffner & Delahunty

[57] ABSTRACT

The invention relates to a method and apparatus for feeding reaction substances, i.e. pulverous solid material and reaction gas, into a smelting furnace, particularly into the top part of the reaction space (1) of a smelting furnace. The reaction gas is fed into the reaction space (1) through at least one feed gate (9) so that the solid material supplied through this feed gate (9) are fed into the reaction space (1) from an area in between the two sub-flows (5, 6) of the divided reaction gas supply flow. Roughly 50–90% of the reaction gas supply is fed from outside the solid material supply.

6 Claims, 1 Drawing Sheet

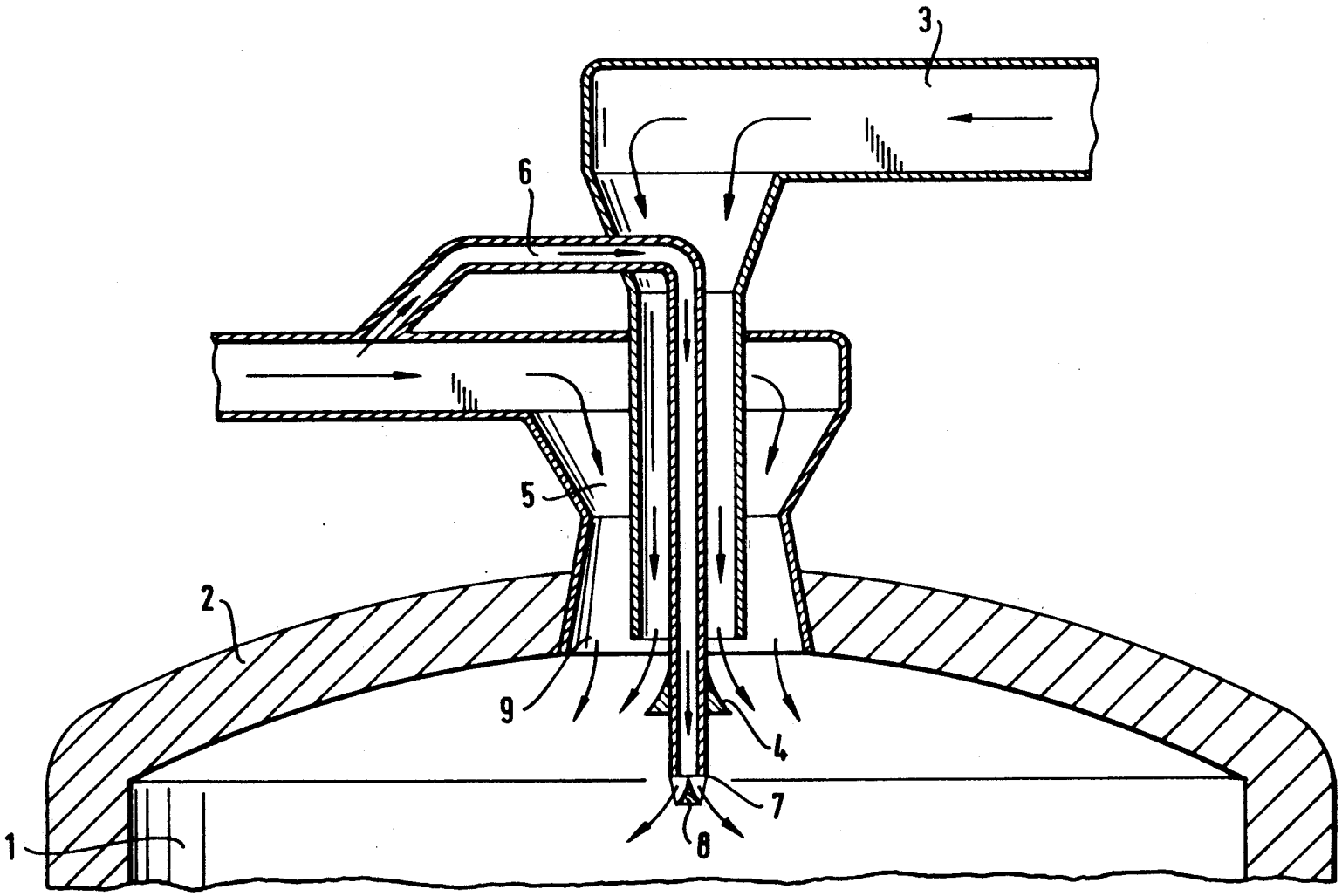
3
6
5
4
7
8
9
2
1

METHOD AND APPARATUS FOR FEEDING REACTING SUBSTANCES INTO A SMELTING FURNACE

The present invention relates to a method and apparatus for feeding reacting substances, particularly pulverous solid material and reaction gas, into a smelting furnace so that the temperature profile of the reaction zone in the smelting furnace is changed to be advantageous with respect to the structural materials of the reaction zone as well as to the smelting result.

While feeding reacting substances into a suspension smelting furnace, the suspension is advantageously produced in the reaction space proper, in which case the pulverous solid material and reaction gas are mixed in the reaction space Thus the mass transfer between the reacting solid particle and the surrounding gas is made as intensive as possible in the reaction space itself, because then the difference in velocity between the reaction gas and the pulverous solid material also is made as great as possible.

The forming of suspension in the reaction space itself is known for example from the Finnish patent 57,786, wherein a pulverous substance is turned, by means of sub-flows falling on an inclined surface, into a downwards directed, annular solid material flow. The reaction gas set into high-force rotary motion in a particular turbulence chamber is allowed to be discharged as parallel to the rotation axis via a throttling stabilizer member, located at the end of the turbulence chamber, to within the annular flow of the pulverous substance, essentially parallel to its axis. From this aperture which opens directly to the reaction space the high-force turbulent jet is discharged as a cone, the angle of opening whereof can be adjusted within the range 15°–180°, and it meets the pulverous flow in the reaction space proper at a sufficient velocity difference.

The FI patent 63,259 also specifies a method and apparatus for producing a suspension jet of pulverous substance and reaction gas in the reaction space. According to the said FI patent, the uniform reaction gas flow is divided into at least three sub-flows, and the direction of the sub-flows is deviated 30°–90°, to be essentially parallel to the central axis of the reaction space, simultaneously as the velocity of the sub-flows is increased. The obtained reaction gas sub-flows are made to be discharged, with minimum pressure losses, as an annular flow, and to surround the flow of pulverous substance supplied from within the flow. This flow of pulverous substance is further made to be discharged and effectively mixed to this reaction gas jet which as a whole is not rotated, in order to create a turbulent but controlled suspension jet which is necessary for the reaction.

In the Finnish patent application 882,463, in the description of the prior art, there is described a concentrate burner where a tubular concentrate chute is kept vertically suspended along the central axis of the burner housing. The bottom part of the burner housing is horn-shaped, whereas the bottom end of the chute is arranged to protrude slightly over the horn-like bottom part of the burner housing. In addition to this, the concentrate burner is provided with an additional fuel burner along the central axis of the concentrate chute, so that the reaction air supplied through the air channel is blown through the horn-shaped part against the solid material that is falling down in the concentrate chute. Further, in the concentrate burner there is installed, in order to maintain a suitable blowing velocity of the reaction air, a conical flow guide in the horn-shaped part, which flow guide is attached to the end of the additional fuel burner.

Further, the FI patent application 882,463 introduces an improvement to the concentrate burner described above. In this new concentrate burner both the additional fuel and the reaction gas proper are fed, centrally with respect to the concentrate supply, directly into the reaction space. In order to orientate the concentrate and to avoid choking of the reaction gas pipe, there is installed a conical flow guide at the outer edge of the reaction gas pipe, by means of which flow guide the concentrate is directed away from the mouth of the reaction gas pipe, towards the periphery of the reaction space.

From the U.S. Pat. No. 4,210,315 there is known an apparatus where a suspension of pulverous solid material and reaction gas is created by feeding the solid material into the reaction space centrally with respect to the reaction gas supply. Coaxially inside the solid material feed pipe there is also installed a gas feed pipe, which is formed to be conical at the bottom end of the solid material feed pipe, so that the gas is discharged through the discharge holes provided at the bottom of the cone. The gas entering through the discharge holes causes the solid material falling along the conical surface to be directed towards the reaction gas zone, towards the periphery of the reaction space.

While creating the suspension of solid material and reaction gas according to the prior art methods, the problem often is that in the middle of the reaction space there is a remarkable surplus of solid material, whereas the amount of reaction gas is not sufficient. This leads to overreactions in the marginal areas of the reaction space, whereas in the middle of the reaction space the solid material reacts incompletely. As a result, the unreacted solid material accumulates in the bottom part of the reaction space, if the temperature is not raised. An increase in the temperature, however, means a strain to the lining of the reaction space as well as to the heating elements.

The object of the present invention is to eliminate some of the drawbacks of the prior art and to achieve an improved and operationally more secure method and apparatus for feeding pulverous solid material and reaction gas into a reaction space, so that the temperature profile of the reaction space can be rendered advantageous both for the durability of the reaction space and for the smelting result.

According to the invention, in order to produce the suspension the pulverous solid material and the reaction gas are fed into the reaction space by means of using at least one feed gate advantageously formed in the top part of the reaction space. By means of the members connected to the said feed gate, the reaction gas supply is divided into two sub-flows, so that the feeding of the solid material takes place in the area in between these two sub-flows. Thus part of the reaction gas is fed into the middle of the reaction space from inside the solid material supply, whereas part of the reaction gas is fed from outside the solid material supply. Both the solid material supply member, and the reaction gas supply member located inside the solid material supply member, are provided with additional members to advantageously direct the reacting substances into the reaction space. Thus the reaction gas entering the reaction space from within the solid material supply advantageously falls directly in an area where there normally is a high suspension density and where the reaction gas enters poorly Thus the reaction rate of the solid material in the middle of the reaction space can be essentially raised without increasing the temperature of the reaction space. By feeding only part of the reaction gas from outside, with respect to the solid material supply point, a possible overreaction in the marginal areas of the reaction space is prevented, and the suspension of the solid material and the reaction gas is rendered essentially homogeneous in density.

By dividing the reaction gas supply into two flows according to the invention, the temperature profile of the reaction space is made more advantageous as compared to the prior art, because the burning of the solid material begins in the inner part of the suspension, too. Simultaneously the temperature in the marginal areas of the reaction space is decreased, because the oxygen content of the reaction gas is decreased while feeding less reaction gas into the marginal areas. The burning of solid material that takes place in the inner part of the suspension further creates a hot zone in the middle of the reaction space, which hot zone prevents the accumulation of material at the point of supply.

By means of the invention, the mixing of solid material with reaction gas is improved, because the reaction gas is brought into the middle of the suspension. Moreover, the hot zone in the middle of the reaction space leads to a powerful expansion of the reaction gas, which pushes the solid material from the middle of the reaction space towards the periphery.

The reacting of solid material takes place further up, within the suspension, owing to the influence of the reaction gas fed, according to the invention, into the middle section of the reaction space. Further, the reaction heat created inside the suspension can be effectively utilized for smelting the solid material, and thus the reaction temperature is not consumed in heat losses. Moreover, the efficiency of the reaction gas fed into the inner part of the suspension is very high, because the reaction gas reaches the exhaust gases from the reaction space only through the solid material.

The invention is explained in more detail below with reference to the appended drawing, which is an illustration of a preferred embodiment of the invention in partial side-view cross-section.

According to the drawing, in the top part of the reaction space of a suspension smelting furnace, i.e. in the top part of the reaction space 1, there is arranged a feed gate 9 for the reacting substances, so that both the fine-divided concentrate serving as the solid material, and the oxygen-bearing gas serving as the reaction gas, are free to flow into the reaction space 1 through the roof 2 of the reaction space. By means of the members provided at the feed gate 9, the solid material is conducted into the reaction space 1 through the duct 3. While falling down in the duct 3, the solid material gets into contact with the conical surface 4 provided in the middle of the duct 3, so that the solid material changes direction towards the periphery of the reaction space.

The reaction gas is fed into the reaction space 1 so that at least half of the reaction gas, advantageously 50–90% thereof, is fed into the reaction space of the suspension smelting furnace through the duct 5, which is installed in the feed gate 9 so that the reaction gas is conducted into the reaction space 1 from outside the solid material duct 3. Thus the solid material directed by means of the conical surface 4 is put into contact with the reaction gas The rest of the reaction gas, at least 10% thereof, advantageously 10–50%, is fed into the reaction space 1 through the reaction gas duct 6 placed inside the solid material duct 3. At the bottom end 7 of the reaction gas duct 6, inside it, there is provided a centrally installed conical surface 8. Both the reaction gas duct 6 and the conical surface 8 extend, over the bottom end of the solid material duct 3, to a lower level. Thus the reaction gas conducted through the reaction gas duct 6 is fed towards the falling solid material particles, so that the still unreacted and/or partly reacted solid material particles are drawn into the influential range of the new reaction gas front.

According to the invention, by dividing the reaction gas supply into two parts by employing two reaction gas ducts 5 and 6, the solid material fed in between these two ducts 5 and 6 gets into contact with the reaction gas fronts entering both from the periphery of the reaction space and from the middle thereof. Thus the temperature profile of the reaction space 1 is rendered advantageous, for the heat released in the reaction leads to a rapid heating of the reaction gas fed into the middle section of the reaction space, and thus improves the reaction velocity of the solid particles. Consequently the heat released in the reaction can be utilized already in the top part of the reaction space, without raising the temperature externally.

I claim:

1. A method for feeding pulverous solid materials and reaction gas into the top part of a reaction space of a smelting furnace, comprising feeding the reaction gas into the reaction space through at least one feed gate, and dividing the reaction gas into two sub-flows so that the solid material fed through this feed gate is fed into the reaction space from an area located in between the two sub-flows of the divided reaction gas supply flow.

2. The method of claim 1, comprising feeding at least half of the reaction gas in from outside the solid material supply flow.

3. The method of claim 1 or 2 comprising feeding 50–90% of the fed reaction gas from outside the solid material supply.

4. The method of claim 1 or 2, comprising feeding at least 10% of the fed reaction gas in from inside the solid material supply.

5. The method of claim 1 or 2, wherein the employed reaction gas is some oxygen-bearing gas.

6. The method of claim 1 or 2, wherein the employed solid material is a concentrate.

* * * * *